US005077873A

United States Patent [19]

Strudel

[11] Patent Number: 5,077,873

[45] Date of Patent: Jan. 7, 1992

[54] EXPANDER FOR TUBULAR TEXTILE FABRIC

[75] Inventor: Werner Strudel, Friedrichshafen, Fed. Rep. of Germany

[73] Assignee: Lindauer Dornier Gesellschaft m.b.H., Lindau, Fed. Rep. of Germany

[21] Appl. No.: 575,497

[22] Filed: Aug. 30, 1990

[30] Foreign Application Priority Data

Sep. 6, 1989 [DE] Fed. Rep. of Germany ..... 3929599

[51] Int. Cl.[5] ..... D06C 3/00

[52] U.S. Cl. ..... 26/80

[58] Field of Search ..... 26/80, 81, 74, 82

[56] References Cited

U.S. PATENT DOCUMENTS

| | | | |
|---|---|---|---|
| 2,668,324 | 2/1954 | Johnson | 26/80 X |
| 3,285,446 | 11/1966 | Strickland | 26/80 X |
| 4,318,209 | 3/1982 | Schuierer | 26/80 X |
| 4,446,632 | 5/1984 | Dornier | 26/81 X |
| 4,541,156 | 9/1985 | Walsh et al. | 26/81 |
| 4,747,190 | 5/1988 | Koch | 26/80 X |
| 4,843,669 | 7/1989 | Koch et al. | 26/80 X |
| 4,885,826 | 12/1989 | Strudel | 26/80 |
| 4,888,848 | 12/1989 | Serracant-Clermont et al. X | 26/80 |

FOREIGN PATENT DOCUMENTS

| | | | |
|---|---|---|---|
| 598261 | 12/1925 | France | 26/80 |
| 2035404 | 6/1980 | United Kingdom | 26/80 |

*Primary Examiner*—Werner H. Schroeder
*Assistant Examiner*—John J. Calvert
*Attorney, Agent, or Firm*—W. G. Fasse

[57] ABSTRACT

Tubular fabric that is being expanded radially outwardly by a so-called circular expander, has a tendency to develop a reduced pressure inside the volume of the tubular fabric, whereby the operation of the expander is hindered. To avoid the formation of reduced pressure, the expander is equipped with at least one air blower nozzle for introducing pressurized air into the space enclosed by the tubular fabric. The air blower nozzle is movable toward and away from the tubular fabric and preferably can stretch the fabric slightly to improve the passage of air through the fabric, which is sufficient permeable to pressurized air.

8 Claims, 4 Drawing Sheets

EXPANDER FOR TUBULAR TEXTILE FABRIC

FIELD OF THE INVENTION

The invention relates to an expander, especially a circular expander, for tubular textile fabric. Such an expander has a carrier, to which several staying arms or struts are pivoted one above the other. The tubular fabric is lead over the ends of these staying or support arms.

BACKGROUND INFORMATION

German Patent Publication (DE) 3,732,754, corresponding to U.S. Pat. No. 4,885,826 (Strudel) describes such an expander.

At the beginning of the treatment process the circular expander is adjusted to its minimal diameter, that means the staying arms or struts extend essentially parallel to the longitudinal axis of the expander, and the textile tubular fabric is lead over the whole expander so that the expander is inside the textile tubular fabric.

As the expanding control for adjusting the expander width is switched on, the staying arms are expanded outwardly at an angle to the longitudinal axial direction, whereby the staying arms are extended and the tubular fabric is expanded to form the tube.

The spreading of the expander takes place in a relatively short time. Experiments of the Applicant have shown, that because of the resulting increase in volume of the tubular fabric, caused by the spreading of the staying arms, a strong reduced pressure is generated in the interior of the tubular fabric. This reduced pressure causes, on the one hand, that the spreading has to occur against the force caused by the reduced pressure and, on the other hand, a danger exists, that the tubular fabric could be deformed radially inwardly between the staying arms, whereby the tubular fabric could be damaged.

OBJECTS OF THE INVENTION

In view of the foregoing it is the aim of the invention to achieve the following objects singly or in combination:

- to provide an expander which prevents the formation of reduced pressure inside the tubular fabric as it is being expanded;
- to make sure that the outward motion of the expander arms is as smooth as possible and not hindered by reduced pressure inside the fabric to be expanded;
- to avoid damage to the tubular fabric as it is being expanded by an expander such as a circular expander;
- to generate an excess pressure inside the tubular fabric as it is being expanded;
- to arrange a blowing device for an effective blowing of pressurized air into the tubular fabric through the fabric and so that a minimal adjustment of the position of the blowing device is required; and
- to synchronize the control of the expander operation with the control of the blower operation.

SUMMARY OF THE INVENTION

According to the invention the above objects have been achieved by a blowing device for blowing pressurized air into the inner space of the expander to generate excess pressure inside the tubular fabric as it is being expanded.

The invention achieves the essential advantage that the undesirable effects of conventional reduced pressure generation in expanders are efficiently avoided by blowing air under excess pressure into the interior of the tubular fabric during the fabric expansion. The pressurized air is preferably introduced at a location where the reduced pressure is mainly generated while the staying arms are being spread outwardly.

By blowing of air into the volume defined by the fabric the harmful reduced pressure is prevented and the staying arms can spread out easily and the expander can adjust radially outwardly without any essential counterforce. At the same time the compressed air passing through the air permeable tubular fabric deforms the fabric radially outwardly, thereby preventing that fabric portions could be sucked inwardly between the staying arms, whereby the fabric could be damaged by the staying arms.

The blowing in of air under excess pressure is performed according to a preferred embodiment of the invention from outside by a blowing device contacting the outer surface or close to the outer surface of the tubular fabric. Such a blowing device has one or more air jets, and each air jet preferably is in contact with the outside of the fabric and the air jet is chosen so that it can pass through the tubular fabric into the interior of the tubular fabric, whereby the above mentioned undesirable effects of prior art are avoided. As mentioned, the fabric is air permeable at least to pressurized air.

Such a blowing device comprises basically an air jet which is adjustable in a radial direction of the expander, that is, perpendicularly to the axial direction of the longitudinal axis of the expander.

The adjustment means for positioning the air nozzle relative to the outer fabric surface must be so constructed that the air nozzle is arranged at least in body contact or close to the fabric surface when the expander is in a retracted position and so that a sufficient air stream can be blown through the fabric into the inner space formed by the tubular fabric. A preferred position for the air nozzle is located near that portion of the expander where the displacement of the blowing device in the radial direction is minimal. This preferred position of the air nozzle is just under the roller head or carrier of the expander near a disk. The fabric runs along this disk practically in any position of the staying arms and thus in any expander position. Therefore, in this location only a short displacement of the nozzle head of the blowing device in a radial direction is needed.

Several embodiments for adjusting the air nozzle head in a radial direction are possible as will be described below.

A first embodiment of the invention provides that the air nozzle for introducing pressurized air into the tubular fabric comprises a piston cylinder device with a piston rod attached to a piston inside a cylinder and extending out of the cylinder. The piston is movable back and forth in the cylinder. The piston rod has a longitudinal axial bore and is connected with the piston so that air is supplied through the piston rod when one cylinder chamber is pressurized. An air nozzle is arranged on the front or free end of the piston rod. When said one cylinder chamber is supplied with pressurized air, the piston with its rod is pushed out and moves in a radially inward direction toward the tubular fabric relative to a longitudinal central expander axis. When the radially inward motion ends, air pressure in said one cylinder chamber causes an air flow through the piston rod and its nozzle end. The air passes through the tubular fabric into the space defined by the tubular fabric.

On the other hand, if the other cylinder chamber is supplied with air, the piston is moved backwardly, whereby the nozzle end of the piston rod moves out of contact with the unfolding or expanding textile fabric.

The just described piston cylinder, piston rod, and nozzle arrangement is a simple constructive solution of the above stated problem and realizes both a movable adjustment drive of the air nozzle and the supply of pressurized air for the air nozzle by only one constructional unit, namely the piston cylinder with the piston rod having an axial bore therein. The axial bore itself may form the nozzle.

In the described embodiment with the piston cylinder device, and with any other back and forth drive for positioning the air nozzle relative to the tubular fabric, it is possible to press the nozzle against the fabric to slightly stretch the fabric where the air nozzle contacts the fabric. This slight stretching needs to be just sufficient to make the fabric more permeable to the passage of air through the fabric than it would normally be without being slightly stretched. Such slight stretching is elastic and does not mar the tubular fabric in any way because the fabric returns to its normal condition just as soon as it comes out of contact with the air nozzle.

BRIEF DESCRIPTION OF THE DRAWINGS

In order that the invention may be clearly understood it will now be described by way of example, with reference to the accompanying drawings, wherein.

DETAILED DESCRIPTION OF PREFERRED EXAMPLE EMBODIMENTS AND OF THE BEST MODE OF THE INVENTION

Figure 1:
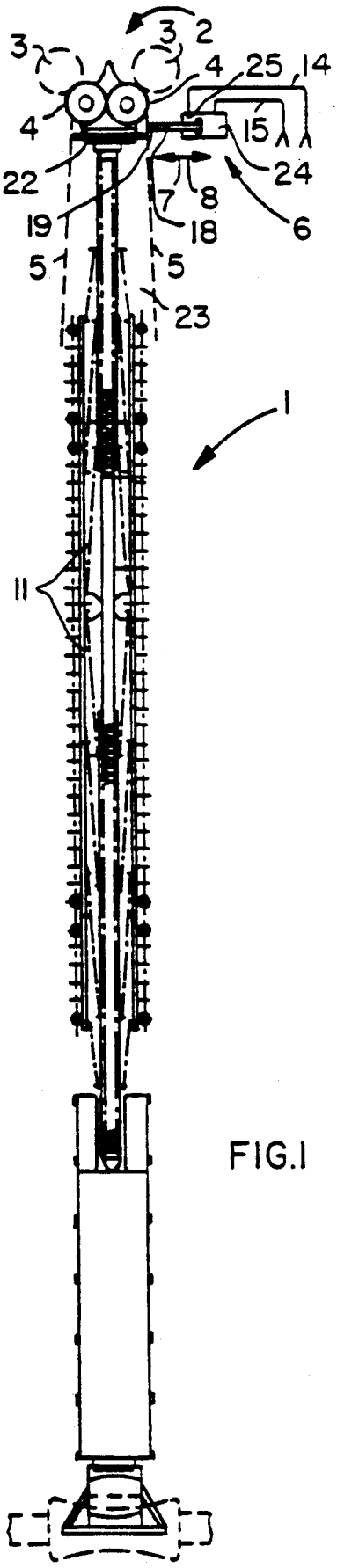
FIG. 1 shows a circular expander for tubular fabric, equipped with a blowing device according to the invention with a blower nozzle in contact with the fabric.
Figure 2:
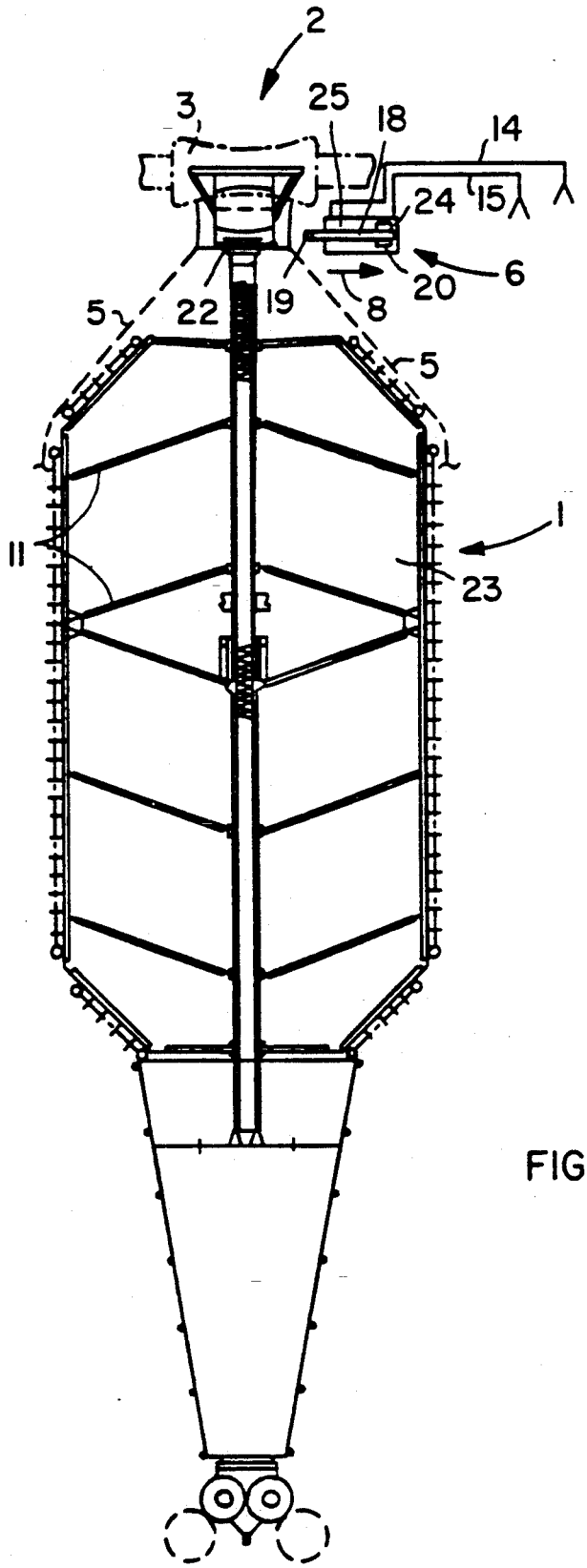
FIG. 2 shows the expander according to FIG. 1, with the blower nozzle retracted away from the fabric.
Figure 3:
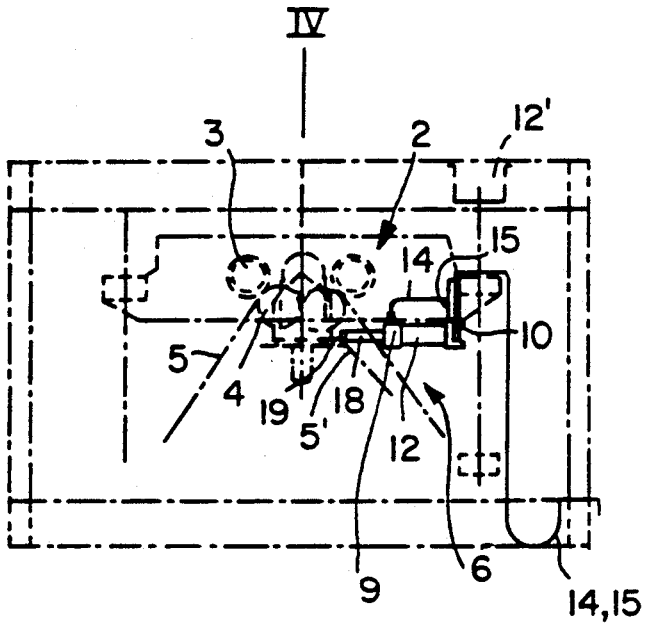
FIG. 3 illustrates the blowing device of FIGS. 1 and 2, with a piston cylinder device for moving the nozzle and for supplying pressurized air to the nozzle.

The expander 1 of FIGS. 1 and 2 is described in detail in U.S. Pat. No. 4,885,826 assigned to the same assignee as the present invention. The disclosure of U.S. Pat. No. 4,885,826 is incorporated herein by reference.

The expander 1 substantially comprises a roller head or carrier 2. Several fabric guide rollers 3 and counter rollers 4 are arranged on the carrier 2. The counter rollers 4 are located below the guide rollers 3 and contact the guide rollers.

The tubular fabric 5 is supplied to pass over the roller head 2 and moves downwardly to surround the expander 1.

At the beginning of the processing, as shown in present FIG. 1, of the tubular fabric 5, the spreader arms 11 of the expander 1 are retracted radially inwardly into the position shown in FIG. 1, wherein the staying or spreader arms 11 are extending substantially in parallel to the longitudinal central axis of the expander 1 and the tubular fabric 5 has its smallest diameter.

During the start of the processing the roller head 2 is driven and at the same time the mechanism for unfolding the staying or spreader arms 11 is operated, so that the expander 1 takes up its fabric spreading position shown in FIG. 2.

During the transition of the tubular fabric 5 from the position in FIG. 1 to the position in FIG. 2, a substantial enlargement of volume of the fabric tube takes place, thereby causing a strong under-pressure or reduced pressure in the inner space 23, see FIG. 2. Such reduced pressure can damage the fabric because it tries to hold back the expander action.

To prevent this reduced pressure during the transition from FIG. 1 to FIG. 2, the invention teaches blowing air into the inner space 23 of the tubular fabric 5 through the permeable fabric.

According to the invention an air blowing device 6 is preferably arranged near the upper inlet of the expander 1 under the roller head 2 opposite to and slightly above a disk plate 22 located under the roller head 2 for leading the fabric onto the expander as shown in FIGS. 1 to 5. An effective position of the air blowing device 6 is near and slightly above the plate 22. Such a position is preferred since it is most efficient in counteracting the above mentioned reduced pressure in space 23. According to FIGS. 1 and 2 the tubular fabric 5 passes along the guide plate 22 in the retracted position and in the extended position of the expander. Therefore, it is advantageous to arrange the air blowing device 6 in the vicinity of the plate 22. This position permits a short adjusting path for the adjustment of the air blowing device 6 in the directions of the arrows 7, 8 and it permits contacting the fabric with an air nozzle 19 in an effective manner.

Figure 4:
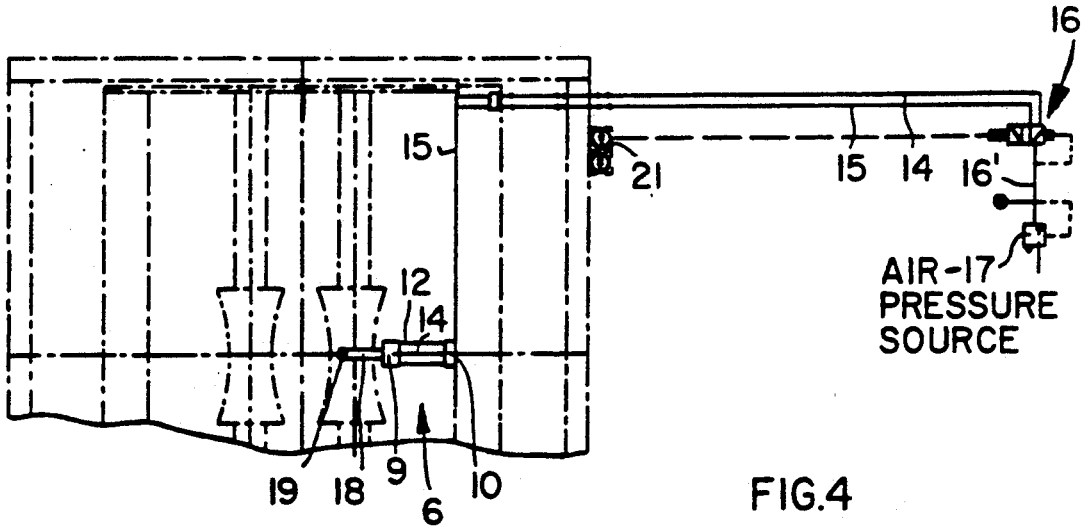
FIG. 4 shows the blowing device of FIG. 3 as viewed in the direction of arrow IV in FIG. 3, and including control means for the movement of the piston with its rod and the supply of pressurized air to the nozzle.
Figure 5:
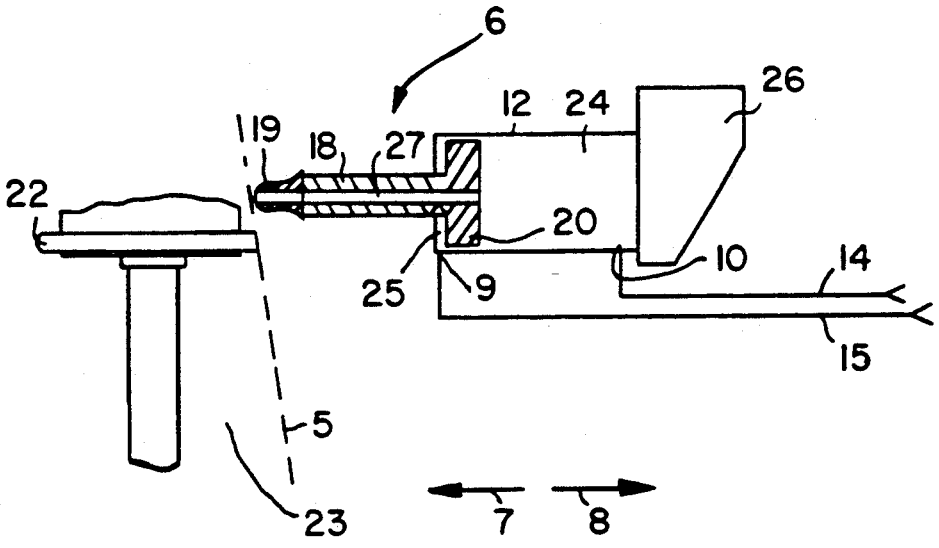
FIG. 5 shows the present blowing device on a somewhat enlarged scale illustrating the piston cylinder device with a piston rod having a longitudinal axial bore leading into a blowing nozzle.

Referring to FIG. 5, the air blowing device 6, which is also shown on a smaller scale in FIGS. 1 to 4, comprises a piston cylinder device 12 with a piston 20 movable back and forth in the directions of the arrows 7, 8. The piston 20 is rigidly connected to a piston rod 18 having a longitudinal bore 27 to provide a supply duct for pressurized air to the air nozzle 19 secured to the front or free end of the piston rod 18. The air nozzle 19 may simply be a restriction in the longitudinal bore 27 in the bore 27 also. The piston rod 18 passes through the piston 20 so that it is connected with the rear cylinder chamber 24 of the piston cylinder device 20 for passing pressurized air to the nozzle 19 through the bore 27. For this purpose the rear cylinder chamber 24 is connected by a connector 10 and a pressure hose 15 to one pressure outlet port of a control valve 16 shown in FIG. 4. The control valve 16 in turn is connected by a conduit 16' to a source 17 of pressurized air. A front cylinder chamber 25 of the cylinder device 12 is connected by a connector 9 and a hose 14 with another pressure outlet of the control valve 16. The piston rod 18 is movable back and forth as indicated by the arrows 7 and 8 as mentioned. However, the cylinder 12 is mounted in a fixed position to a bracket 26 which in turn is secured to a frame member 12' of the expander.

Referring to FIG. 4, the control valve 16 is operated by energizing a solenoid through an on-off switch 21, which thus operates the control valve 16 and also the starting of the machine drive of the expander 1.

In the position shown in FIG. 1, the machine is at a standstill and the piston rod 18 is extended in the direction of the arrow 7 so that the nozzle 19 of the rod 18 is close to the tubular fabric 5 on the still retracted expander 1. By switching on the on-off switch 21, FIG. 4, the control valve 16 is changed over, and air under pressure passes through the hose 15 and the connector 10 into the rear cylinder chamber 24, whereby pressurized air in the cylinder chamber 24 flows through the bore 27 through the piston 20 and the piston rod 18 and out through the nozzle 19 that is arranged at the free end of the piston rod 18.

Thus, a substantial or sharp air jet is blown by the nozzle 19 into the space 23 enclosed by the tubular fabric 5. The excess pressure counteracts the above reduced pressure, thereby inflating the tubular fabric like a balloon. The tubular fabric is thus easily spread by the effect of the unfolding staying arms 11 of the expander 1.

The blowing of a pressurized air jet through the nozzle 19 into the inner space 23 of the tubular fabric 5 may, for instance, be controlled by the switching operation of a timing relay not shown, to avoid over-expanding the tubular fabric 5.

When the expander 1 assumes its position according to FIG. 2, the staying arms 11 have been completely unfolded radially outwardly. At this time the piston rod 18 is retracted into the cylinder device 12 in the direction of arrow 8 by the admission of pressurized air into chamber 25 of the cylinder device 12. For this purpose the control valve 16 is switched over for feeding compressed air through the hose or pipe 14 and the connector 9 into the front cylinder chamber 25. Thus, at first the cylinder chamber 24 becomes pressureless, and the air supply to the nozzle 19 is also interrupted. Pressure admission to the chamber 25 causes the piston rod 18 to move back into the cylinder device 12 in the direction of the arrow 8, and the air nozzle 19 moves out of contact with the surface of the tubular fabric 5.

A trip-dog operated end switch, not shown, may be provided for switching the blowing device 6 off.

The present device and its manner of operation achieve the essential advantage that an easy and reliable unfolding of the expander from its retracted position to its radially outwardly extended position is guaranteed, and that the tubular fabric does not deform in a disadvantageous manner radially inwardly on account of the reduced pressure that resulted in the inner space 23 heretofore.

The air volume, the air speed through the nozzle 19, and the number of nozzles will be selected primarily in accordance with the type of tubular fabric involved. This selection also applies to the particular position of the nozzle or nozzles along the expander.

Referring again to FIG. 3, it will be noted that the nozzle 19 pressing against the fabric 5 stretches the fabric slightly out of its normal path inwardly toward the longitudinal central axis of the expander to follow a deviated or stretched path 5'. This feature of the invention makes sure that a slight stretching of the fabric where it contacts the nozzle 19, makes the fabric somewhat more permeable to the air coming out of the nozzle 19 thereby facilitating the generation of an excess pressure inside the volume 23 formed by the fabric 5 as it is being expanded. The fabric is sufficiently elastic to immediately return to its normal path when the piston rod 18, and thus the nozzle 19, are withdrawn from contact with the fabric 5. No visible marks are caused by such slight stretching of the fabric.

Although the invention has been described with reference to specific example embodiments, it will be appreciated that it is intended to cover all modifications and equivalents within the scope of the appended claims.

What I claim si:

1. An expander for tubular fabric, comprising frame means, fabric expander means operatively mounted in said frame means, said expander means causing a reduced pressure zone in said tubular fabric while expanding said tubular fabric, and air blower means including at least one air blower nozzle supported by said frame means in a position for blowing pressurized air into said reduced pressure zone enclosed by said tubular fabric as said tubular fabric is being expanded by said fabric expander means.

2. The expander of claim 1, wherein said at least one air blower nozzle is positioned on the outside of said tubular fabric.

3. The expander of claim 2, further comprising means for positioning said air blower nozzle substantially in contact with and out of contact with an outer surface of said tubular fabric.

4. The expander of claim 2, further comprising a disk plate at an inlet end of said fabric expander means for leading said tubular fabric onto said expander, and wherein said air blower nozzle is positioned next to and upstream of said disk plate as viewed in a travel direction of said tubular fabric along said expander.

5. The expander of claim 3, wherein said positioning means comprise means for adjusting the position of said air blower nozzle in a direction substantially perpendicularly to a longitudinal axis of said fabric expander.

6. The expander of claim 5, wherein said air blower nozzle position adjusting means comprise a piston cylinder device.

7. The expander of claim 6, wherein said piston cylinder device comprises a piston rod having a longitudinal bore therethrough, said air blower nozzle being arranged at a free end of said piston rod to communicate through said longitudinal bore with a source of pressurized air passing through said piston cylinder device.

8. The expander of claim 5, wherein said means for adjusting the position of said air blower nozzle reach with said air blower nozzle radially inwardly toward said longitudinal axis for slightly deviating said tubular fabric inwardly from its normal expanded path, whereby said tubular fabric is slightly stretched where said air blower nozzle contacts said tubular fabric for facilitating air entry into said reduced pressure zone in said tubular fabric.

* * * * *